US008854354B2

(12) United States Patent
Ahn et al.

(10) Patent No.: US 8,854,354 B2
(45) Date of Patent: Oct. 7, 2014

(54) POWER SUPPLY CIRCUIT FOR LIQUID CRYSTAL DISPLAY DEVICE THAT CHANGES DURATIONS OF CONTROL SIGNALS

(75) Inventors: Yong Sung Ahn, Ansan-si (KR); Jung Min Choi, Daejeon-si (KR); Sang Rok Cha, Cheongju-si (KR); Dae Keun Han, Daejeon-si (KR); Hyung Seog Oh, Daejeon-si (KR); Yong Suk Kim, Daegu-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 555 days.

(21) Appl. No.: 12/909,272

(22) Filed: Oct. 21, 2010

(65) Prior Publication Data

US 2012/0044227 A1 Feb. 23, 2012

(30) Foreign Application Priority Data

Aug. 18, 2010 (KR) ..... 10-2010-0079919

(51) Int. Cl.
*G09G 5/00* (2006.01)
*G09G 3/36* (2006.01)

(52) U.S. Cl.
CPC ..... *G09G 3/3696* (2013.01); *G09G 3/3677* (2013.01); *G09G 2330/02* (2013.01); *G09G 2330/06* (2013.01)
USPC ..... 345/213

(58) Field of Classification Search
USPC ..... 345/211, 213
See application file for complete search history.

(56) References Cited

U.S. PATENT DOCUMENTS

| | | | | |
|---|---|---|---|---|
| 6,236,394 | B1 | 5/2001 | Ikeda | |
| 2001/0020939 | A1 * | 9/2001 | Ikeda | 345/211 |
| 2001/0030571 | A1 * | 10/2001 | Tsutsui et al. | 327/536 |
| 2001/0030645 | A1 * | 10/2001 | Tsutsui et al. | 345/211 |
| 2002/0154109 | A1 * | 10/2002 | Ikeda | 345/211 |
| 2009/0135171 | A1 * | 5/2009 | Chen et al. | 345/211 |
| 2010/0103150 | A1 | 4/2010 | Huang et al. | |
| 2011/0273433 | A1 * | 11/2011 | Ahn et al. | 345/211 |

FOREIGN PATENT DOCUMENTS

| | | |
|---|---|---|
| JP | 2001-244799 A | 9/2001 |
| JP | 2004-061892 | 2/2004 |
| JP | 3569922 | 7/2004 |
| JP | 2004-361841 | 12/2004 |
| JP | 2006-267313 | 10/2006 |
| JP | 2007-159351 | 6/2007 |
| JP | 2008-271471 | 11/2008 |

(Continued)

*Primary Examiner* — Adam J Snyder
(74) *Attorney, Agent, or Firm* — Kile Park Reed & Houtteman PLLC

(57) ABSTRACT

A power supply circuit of a liquid crystal display device includes a first positive polarity charge charging unit including a first capacitor connected to positive and negative power terminals through switches to charge a charge, a second positive polarity charge charging unit including a second capacitor connected to the positive power terminal and a ground terminal through switches to charge a charge, a first positive polarity charge loading unit loading the charge supplied through the positive power terminal to a negative polarity terminal, a second positive polarity charge loading unit loading the charge charged in the first capacitor to a negative polarity terminal, a third positive polarity charge loading unit loading the charge charged in the second capacitor, and a positive polarity charge charging/loading control unit outputting charging control signals with a same phase to the switches, and periodically or irregularly changing durations of the charging and loading control signals.

19 Claims, 7 Drawing Sheets

(56) References Cited

FOREIGN PATENT DOCUMENTS

| | | | | |
|---|---|---|---|---|
| JP | 2008-271471 A | | 11/2008 | |
| JP | 2009-048006 | | 3/2009 | |
| JP | 2009-168970 | | 7/2009 | |
| JP | 2009168970 A | * | 7/2009 | ..... G09G 3/36 |
| JP | 2009-300728 | | 12/2009 | |
| JP | 2010-081686 A | | 4/2010 | |
| TW | 200923892 | | 6/2009 | |
| TW | 201017631 | | 5/2010 | |

* cited by examiner

POWER SUPPLY CIRCUIT FOR LIQUID CRYSTAL DISPLAY DEVICE THAT CHANGES DURATIONS OF CONTROL SIGNALS

BACKGROUND OF THE INVENTION

1. Field of the Invention

The present invention relates to a technology for supplying power necessary for driving a panel of a liquid crystal display device, and more particularly, to a power supply circuit of a liquid crystal display device, which can suppress electromagnetic interference (EMI) by using charging control signals and loading control signals periodically or irregularly changed when a gate voltage is generated.

2. Description of the Related Art

FIG. 1 is a schematic block diagram illustrating a conventional liquid crystal display device. Referring to FIG. 1, the liquid crystal display device includes a liquid crystal panel 110, in which a plurality of gate lines and a plurality of data lines are arranged while being cross each other to define a plurality of pixel areas in a matrix shape, and an LDI driver IC 120. The LDI driver IC 120 includes a driving circuit unit 121 that supplies the liquid crystal panel 110 with a driving signal and a data signal, and a power supply 122 that supplies power necessary for the driving circuit unit 121.

The driving circuit unit 121 includes a gate driver 121A, a source driver 121B, and a timing controller 121C.

The gate driver 121A outputs a gate driving signal for driving each gate line of the liquid crystal panel 110.

The source driver 121B outputs a data signal to each data line of the liquid crystal panel 110.

The timing controller 121C controls the driving of the power supply 122 as well as the driving of the gate driver 121A and the source driver 121B.

The power supply 122 includes a power controller 122A, a source power driver 122B, and a gate power driver 122C.

The power controller 122A controls the driving of the source power driver 122B and the gate power driver 122C under the control of the timing controller 121C.

The gate power driver 122C generates and supplies a gate high voltage $V_{GH}$ and a gate low voltage $V_{GL}$, which are required when the gate driver 121A generates the gate driving signal.

A power supply circuit provided in the gate power driver always outputs a switching pulse with the same phase as illustrated in FIG. 2A when outputting charging control signals and loading control signals for generating the gate high voltage $V_{GH}$ and the gate low voltage $V_{GL}$. Therefore, the spectrum is concentrated at a band around the center frequency $f_o$ as illustrated in FIG. 2B.

The source power driver 122B supplies panel driving voltages VDDP and VDDN with positive and negative polarities, which are required when the source driver 121B generates the data signal.

As described above, the power supply circuit provided in the gate power driver outputs the charging control signals and the loading control signals with fixed phases in order to generate the high gate voltage and the low gate voltage, thereby causing severe electromagnetic interference (EMI).

Furthermore, since charging control signals and loading control signals with different phases are used whenever a new frame starts, an image may be unstably displayed.

SUMMARY OF THE INVENTION

Accordingly, the present invention has been made in an effort to solve the problems occurring in the related art, and an object of the present invention is to periodically or irregularly change the durations of charging control signals and loading control signals when a power supply circuit provided in a gate power driver outputs the charging control signal and the loading control signal in order to generate a high gate voltage and a low gate voltage, and to provide charging control signals and loading control signals with the same phase whenever a new frame starts.

In order to achieve the above object, according to one aspect of the present invention, there is provided a power supply circuit of a liquid crystal display device, including: a first positive polarity charge charging unit including a first capacitor having both ends connected to a positive power terminal and a negative power terminal through first and second switches, thereby charging a charge; a second positive polarity charge charging unit including a second capacitor having both ends connected to the positive power terminal and a ground terminal through third and fourth switches, thereby charging a charge; a first positive polarity charge loading unit that loads the charge, which is supplied through the positive power terminal, to a negative polarity terminal of the first capacitor of the first positive polarity charge charging unit; a second positive polarity charge loading unit that loads the charge, which is charged in the first capacitor of the first positive polarity charge charging unit, to a negative polarity terminal of the second capacitor of the second positive polarity charge charging unit; a third positive polarity charge loading unit that loads the charge, which is charged in the second capacitor of the second positive polarity charge charging unit, to a third capacitor connected to a gate high power terminal; and a positive polarity charge charging and loading control unit that outputs charging control signals with a same phase to the first and second switches of the first positive polarity charge charging unit and the third and fourth switches of the second positive polarity charge charging unit whenever a new frame starts, and periodically or irregularly changes durations of the charging control signals and durations of loading control signals which are outputted to each switch of the first to third positive polarity charge loading units.

According to another aspect of the present invention, there is provided a power supply circuit of a liquid crystal display device, including: a negative polarity charge charging unit including a first capacitor having both ends connected to a positive power terminal and a negative power terminal through first and second switches, thereby charging a charge; a first negative polarity charge loading unit that loads a charge, which is supplied through a ground terminal, to a positive polarity terminal of the first capacitor of the negative polarity charge charging unit; a second negative polarity charge loading unit that loads the negative polarity charge, which is charged in the first capacitor of the negative polarity charge charging unit, to a second capacitor connected to a gate low power terminal; and a negative polarity charge charging and loading control unit that outputs charging control signals with a same phase to the first switch of the negative polarity charge charging unit whenever a new frame starts, and periodically or irregularly changes durations of the charging control signals and durations of loading control signals which are outputted to each switch of the first and second negative polarity charge loading units.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Reference will now be made in greater detail to a preferred embodiment of the present invention, an example of which is illustrated in the accompanying drawings.

Figure 1:
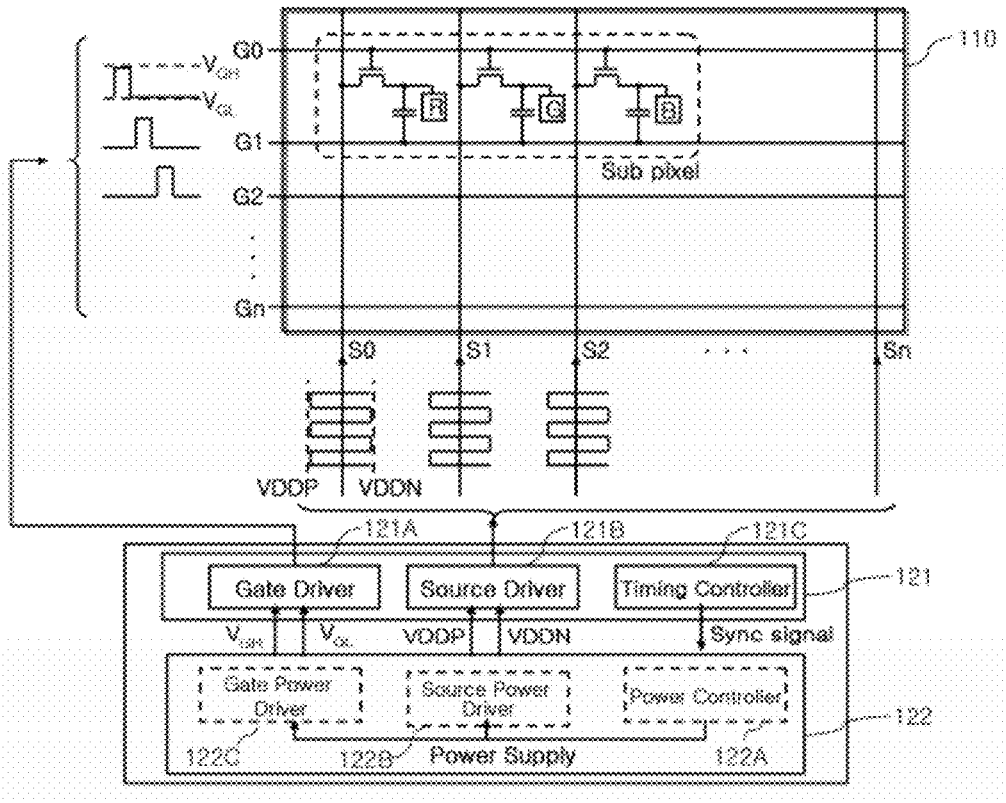
FIG. 1 is a schematic block diagram illustrating a conventional liquid crystal display device.
Figure 2:
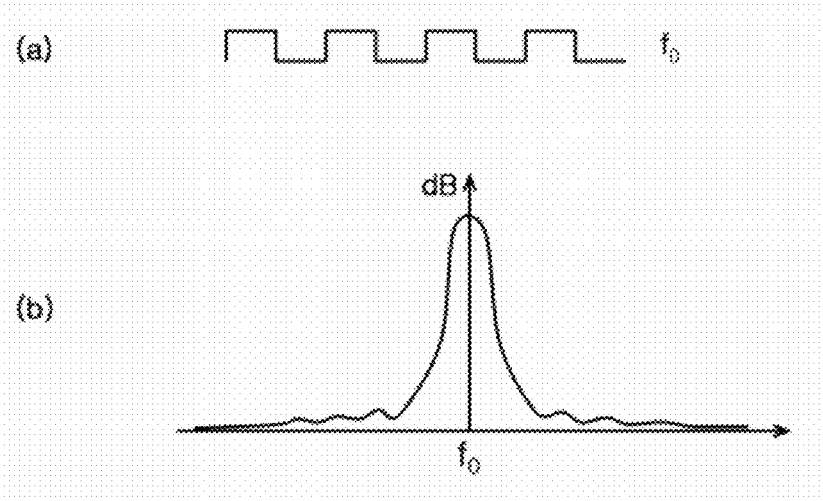
FIG. 2A is a waveform diagram of a switching pulse in a conventional power supply circuit.
FIG. 2B is a diagram illustrating a spectrum in a conventional power supply circuit.
Figure 3:
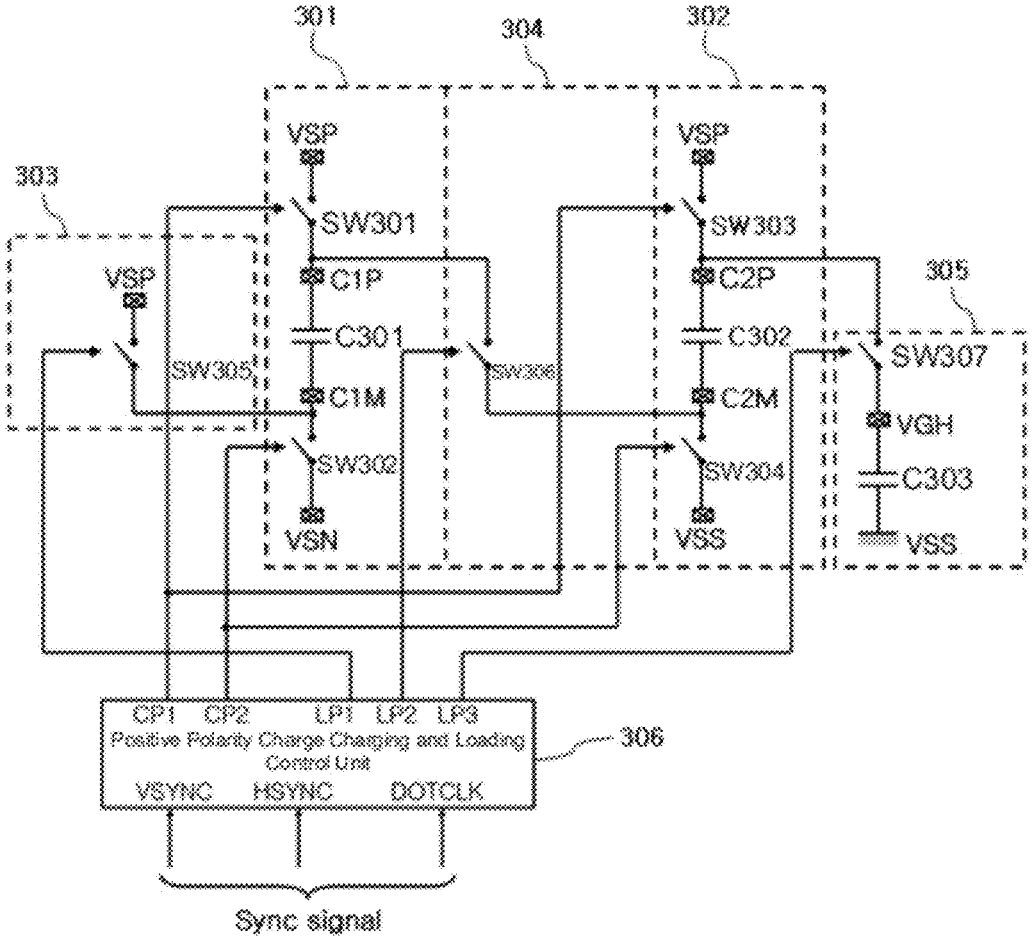
FIG. 3 is a diagram illustrating a power supply circuit of a liquid crystal display device in accordance with one embodiment of the present invention.

FIG. 3 is a diagram illustrating a power supply circuit of a liquid crystal display device in accordance with one embodiment of the present invention. Referring to FIG. 3, the power supply circuit includes a first positive polarity charge charging unit 301, a second positive polarity charge charging unit 302, first to third positive polarity charge loading units 303 to 305, and a positive polarity charge charging and loading control unit 306. The power supply circuit of FIG. 3 is provided in the power supply 122 of FIG. 1, and charges and outputs a positive polarity charge.

The first positive polarity charge charging unit 301 includes a switch SW301, a capacitor C301 and a switch SW302, which are serially connected between a positive (+) power terminal VSP and a negative (−) power terminal VSN.

The second positive polarity charge charging unit 302 includes a switch SW303, a capacitor C302 and a switch SW304, which are serially connected between the positive power terminal VSP and a ground terminal VSS.

The first positive polarity charge loading unit 303 includes a switch SW305 connected between a negative polarity port C1M of the first positive polarity charge charging unit 301 and the positive power terminal VSP.

The second positive polarity charge loading unit 304 includes a switch SW306 which connects a positive polarity port C1P of the first positive polarity charge charging unit 301 to a negative polarity port C2M of the second positive polarity charge charging unit 302.

The third positive polarity charge loading unit 305 includes a switch SW307 and a capacitor C303, which are serially connected between a positive polarity port C2P of the second positive polarity charge charging unit 302 and the ground terminal VSS.

Figure 5:
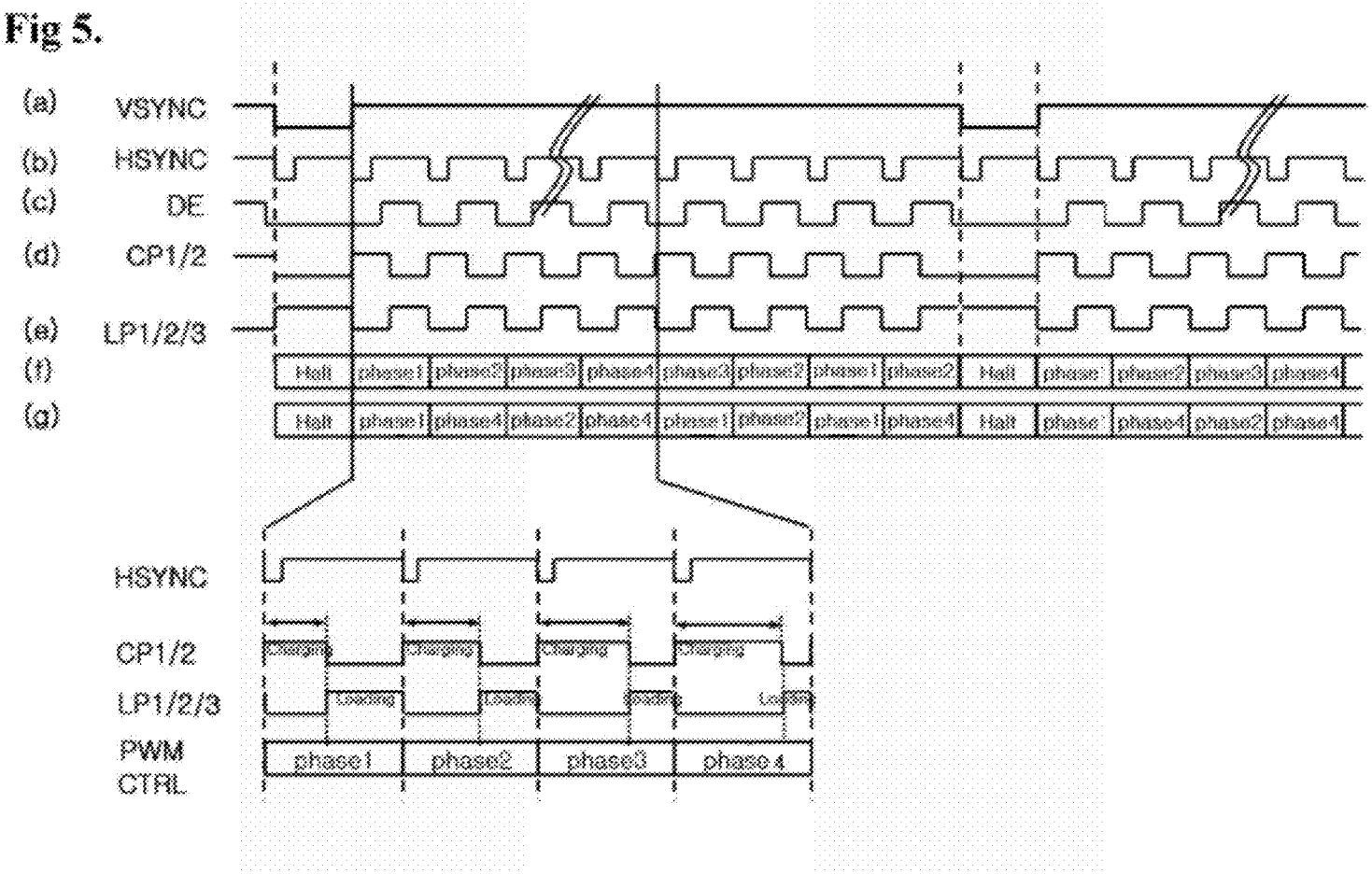
FIGS. 5A to 5G are waveform diagrams of each element of FIG. 3 and FIG. 4.

The positive polarity charge charging and loading control unit 306 outputs the charging control signals CP1 and CP2 as illustrated in FIG. 5D in synchronization with the horizontal synchronization signal HSYNC as illustrated in FIG. 5B after the low duration of the vertical synchronization signal VSYNC as illustrated in FIG. 5A. Thus, the switches SW301 and SW302 of the first positive polarity charge charging unit 301 and the switches SW303 and SW304 of the second positive polarity charge charging unit 302 are turned on in the high duration of the charging control signals CP1 and CP2. Consequently, a charge is charged in the capacitor C301 by a supply voltage supplied to the positive power terminal VSP and the negative power terminal VSN, and a charge is charged in the capacitor C302 by a supply voltage supplied to the positive power terminal VSP and the ground terminal VSS.

Furthermore, the positive polarity charge charging and loading control unit 306 outputs the loading control signals LP1 to LP3, which have phases opposite to those of the charging control signals CP1 and CP2, as illustrated in FIGS. 5D and 5E in synchronization with the horizontal synchronization signal HSYNC. Thus, the switch SW305 of the first positive polarity charge loading unit 303, the switch SW306 of the second positive polarity charge loading unit 304, and the switch SW307 of the third positive polarity charge loading unit 305 are turned on in the high duration of the loading control signals LP1 to LP3.

Consequently, the supply voltage of the positive power terminal VSP is supplied to the negative polarity port C1M connected to the negative polarity terminal of the capacitor C301 of the first positive polarity charge charging unit 301 through the switch SW305, resulting in an increase in the level of a charging voltage across the capacitor C301.

The charging voltage with the increased level across the capacitor C301 is supplied to the negative polarity port C2M connected to the negative polarity terminal of the capacitor C302 of the second positive polarity charge charging unit 302 through the switch SW306, resulting in an increase in the level of a charging voltage across the capacitor C302.

The charging voltage across the capacitor C302 of the second positive polarity charge charging unit 302, which has the increased level through the two-times loading operations as described above, is charged in the capacitor C303 through the switch SW307. The voltage charged in the capacitor C303 is outputted to an outside through a gate high power terminal VGH.

Meanwhile, the positive polarity charge charging and loading control unit 306 outputs charging control signals CP1 and CP2 with the same phase (e.g., a phase 1) and loading control signals LP1 to LP3 with the same phase (e.g., a phase 1) at the first horizontal line whenever a new frame starts as illustrated in FIGS. 5D to 5G.

Figure 6:
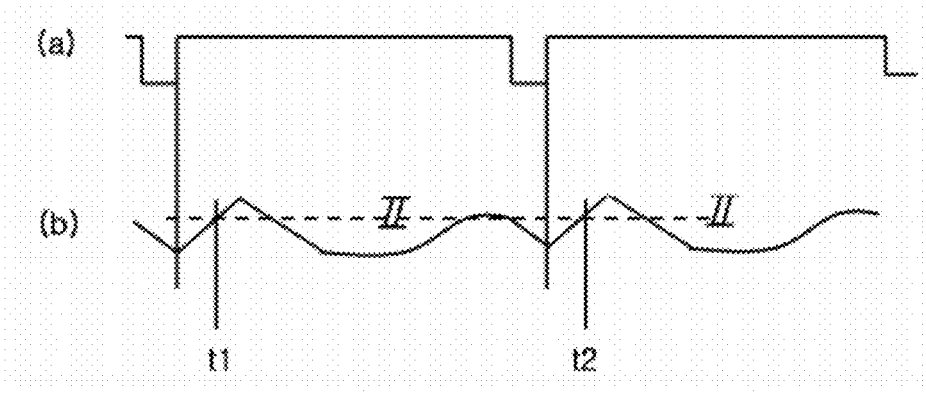
FIG. 6A is a waveform diagram of a synchronization signal.
FIG. 6B is a waveform diagram of a power signal.

Consequently, a liquid crystal panel can be driven with the same driving voltage whenever each frame starts as illustrated in FIGS. 6A and 6B. For reference, FIG. 6A is a waveform diagram of the vertical synchronization signal VSYNC, and FIG. 6B is a waveform diagram of the gate high voltage $V_{GH}$ and the gate low voltage $V_{GL}$, which are generated by the positive power terminal VSP and the negative power terminal VSN.

Then, the positive polarity charge charging and loading control unit 306 periodically or irregularly changes the charging durations of the charging control signals CP1 and CP2 and the loading durations of the loading control signals LP1 to LP3 as illustrated in FIGS. 5D to 5F, so that a spread spectrum is achieved.

Furthermore, when considering that a display operation is not performed in the low duration of the vertical synchronization signal VSYNC as illustrated in FIG. 5B, it is possible to prevent power waste by halting the switching operations of the switches.

Figure 4:
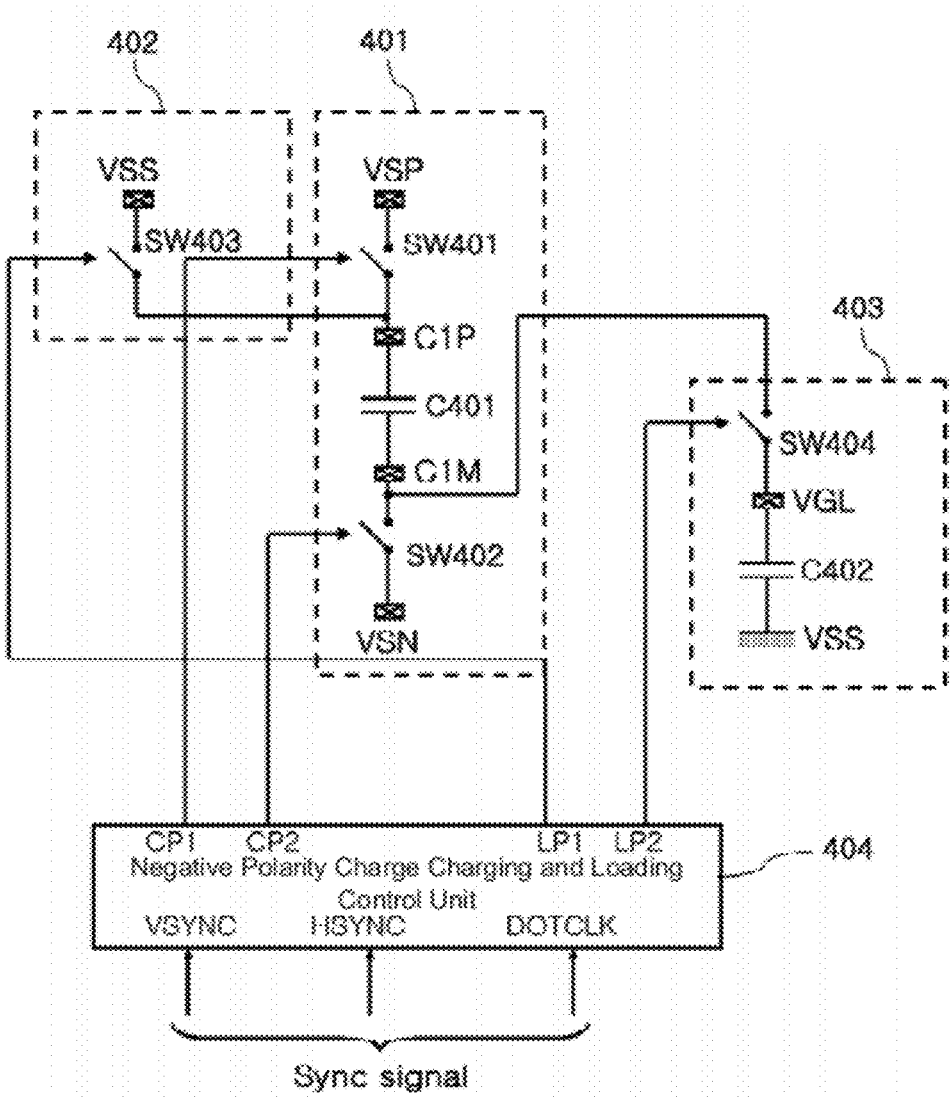
FIG. 4 is a diagram illustrating a power supply circuit of a liquid crystal display device in accordance with another embodiment of the present invention.

FIG. 4 is a diagram illustrating a power supply circuit of a liquid crystal display device in accordance with another embodiment of the present invention. Referring to FIG. 4, the power supply circuit includes a negative polarity charge charging unit 401, a first negative polarity charge loading unit 402, a second negative polarity charge loading unit 403, and a negative polarity charge charging and loading control unit 404.

The basic operational principle of the power supply circuit of FIG. 4 is similar to that of the power supply circuit of FIG. 3, which will be described below.

The negative polarity charge charging unit 401 includes a switch SW401, a capacitor C401 and a switch SW402, which are serially connected between a positive power terminal VSP and a negative power terminal VSN.

The first negative polarity charge loading unit 402 includes a switch SW403 connected between a positive polarity port C1P of the negative polarity charge charging unit 401 and a ground terminal VSS.

The second negative polarity charge loading unit 403 includes a switch SW404 and a capacitor C402, which are serially connected between a negative polarity port C1M of the negative polarity charge charging unit 401 and the ground terminal VSS.

The negative polarity charge charging and loading control unit 404 outputs the charging control signals CP1 and CP2 as illustrated in FIG. 5D in synchronization with the horizontal synchronization signal HSYNC as illustrated in FIG. 5B after the low duration of the vertical synchronization signal VSYNC as illustrated in FIG. 5A. Thus, the switch SW401 and SW402 of the negative polarity charge charging unit 401 are turned on in the high duration of the charging control signals CP1 and CP2. Consequently, a charge is charged in the capacitor C401 by a supply voltage of the positive power terminal VSP and the negative power terminal VSN.

Furthermore, the negative polarity charge charging and loading control unit 404 outputs the loading control signals LP1 and LP2 as illustrated in FIG. 5E in synchronization with the horizontal synchronization signal HSYNC. Thus, the switch SW403 of the first negative polarity charge loading unit 402, and the switch SW404 of the second negative polarity charge loading unit 403 are turned on in the high duration of the loading control signals LP1 and LP2.

Consequently, the supply voltage of the ground terminal VSS is supplied to the positive polarity port C1P connected to the positive polarity terminal of the capacitor C401 of the negative polarity charge charging unit 401 through the switch SW403, resulting in a reduction in the level of a charging voltage across the capacitor C401.

The charging voltage across the capacitor C401 of the negative polarity charge charging unit 401, which has the reduced level through the loading operation as described above, is charged in the capacitor C402 through the switch SW404. The voltage charged in the capacitor C402 is outputted to an outside through a gate low power terminal VGL.

Meanwhile, the negative polarity charge charging and loading control unit 404 outputs charging control signals CP1 and CP2 with the same phase (e.g., a phase 1) and loading control signals LP1 and LP2 with the same phase (e.g., a phase 1) at the first horizontal line whenever a new frame starts as illustrated in FIGS. 5D to 5G. Consequently, a liquid crystal panel can be driven with the same driving voltage whenever each frame starts as described in FIGS. 6A and 6B.

Then, the negative polarity charge charging and loading control unit 404 periodically or irregularly changes the charging durations of the charging control signals CP1 and CP2 and the loading duration of the loading control signals LP1 and LP2 as illustrated in FIGS. 5D to 5G, so that a spread spectrum is achieved.

Furthermore, when considering that a display operation is not performed in the low duration of the vertical synchronization signal VSYNC as illustrated in FIG. 5B, it is possible to prevent power waste by halting the switching operations of the switches.

Figure 7:
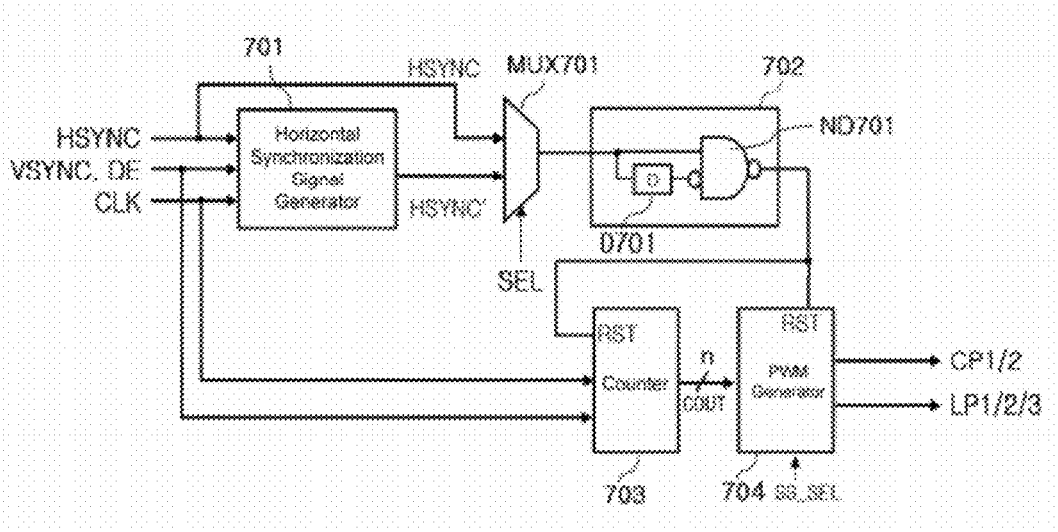
FIG. 7 is a detailed block diagram illustrating the positive polarity charge charging and loading control unit of FIG. 3 or the negative polarity charge charging and loading control unit of FIG. 4.

FIG. 7 is a detailed block diagram illustrating the positive polarity charge charging and loading control unit 306 of FIG. 3 or the negative polarity charge charging and loading control unit 404 of FIG. 4 in accordance with one embodiment of the present invention. Referring to FIG. 7, each of them includes a horizontal synchronization signal generator 701, a multiplexer MUX701, a reset signal generator 702, a counter 703, and a PWM generator 704.

The horizontal synchronization signal generator 701 refers to a vertical synchronization signal VSYNC, a data enable signal DE and a horizontal synchronization signal HSYNC, which are actually inputted, to generate a horizontal synchronization signal HSYNC' similar to the horizontal synchronization signal HSYNC.

The multiplexer MUX701 selects and outputs one of the horizontal synchronization signals HSYNC and HSYNC' according to a selection signal SEL.

The reset signal generator 702 delays the horizontal synchronization signal, which is inputted from the multiplexer MUX701, through a delay section D701 by a predetermined time, and generates a reset signal by performing a NAND operation on the delayed signal through a NAND gate ND701.

The counter 703 generates n-bit output COUT, and is reset with the same period as that of the horizontal synchronization signal HSYNC by the reset signal which is inputted from the reset signal generator 702. The PWM generator 704 receives the output COUT of the counter 703 to generate the charging control signals CP1 and CP2 and loading control signals LP1 to LP3, which have phases 1 to n of a predetermined pulse width.

Figure 8:
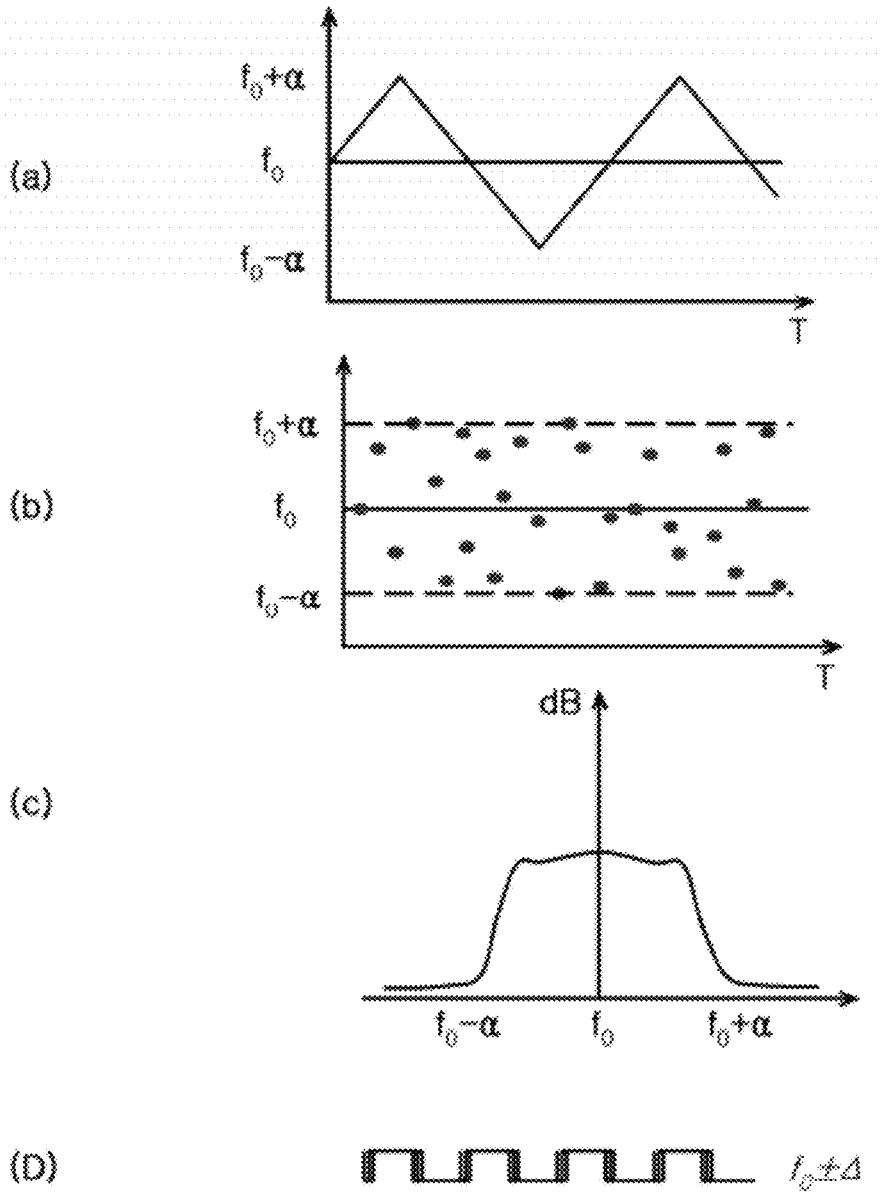
FIG. 8A is a graph illustrating a frequency changed in a regular pattern in accordance with the present invention.
FIG. 8B is a graph illustrating a frequency changed in a random pattern in accordance with the present invention.
FIG. 8C is a graph illustrating a spectrum in which a frequency is changed and energy is spread in accordance with the present invention.
FIG. 8D is a waveform diagram illustrating a switching pulse generated after a frequency is changed in accordance with the present invention.

FIGS. 8A to 8D are diagrams illustrating frequency patterns and spectrums of the charging control signals CP1 and CP2 and the loading control signals LP1 to LP3 which are output from the PWM generator 704. That is, the PWM generator 704 generates the charging control signals CP1 and CP2 and the loading control signals LP1 to LP3, which have a frequency changed in a regular pattern about the center frequency $f_o$ as illustrated in FIG. 8A, or generates the charging control signals CP1 and CP2 and the loading control signals LP1 to LP3, which have a frequency hopping irregularly about the center frequency $f_o$ as illustrated in FIG. 8B.

Thus, the spectrum formed by the power supply circuit in accordance with the present invention is widely spread as illustrated in FIG. 8C without being concentrated at a band around the center frequency $f_o$. FIG. 8D is a diagram illustrating a waveform when the charging control signals CP1 and CP2 and the loading control signals LP1 to LP3, which are output from the PWM generator 704, are outputted in the form of a variable frequency.

Figure 9:
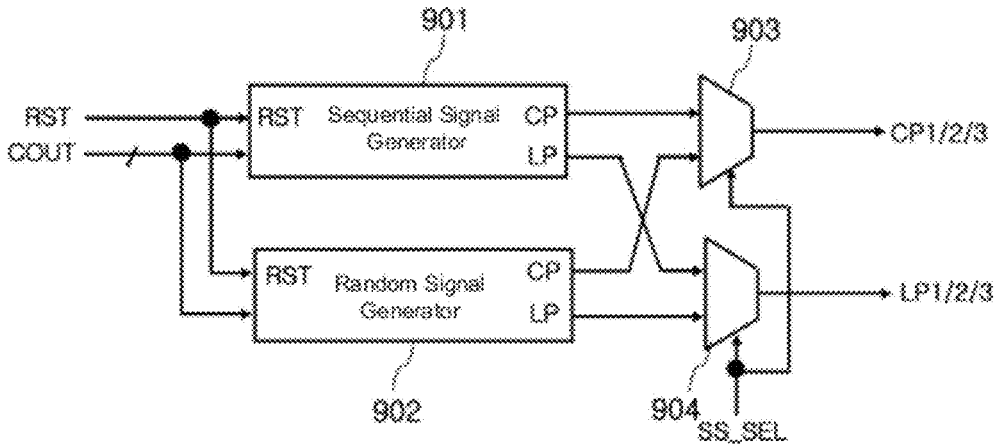
FIG. 9 is a detailed block diagram illustrating the PWM generator of FIG. 7.

FIG. 9 is a diagram illustrating the PWM generator 704 in accordance with one embodiment of the present invention. The PWM generator 704 includes a sequential signal generator 901, a random signal generator 902, and multiplexers 903 and 904.

The sequential signal generator 901 regularly changes the phases of the charging control signals CP1 and CP2 and the loading control signals LP1 to LP3 as illustrated in FIG. 5F. The random signal generator 902 irregularly changes the phases of the charging control signals CP1 and CP2 and the loading control signals LP1 to LP3 as illustrated in FIG. 5G.

The output signals of the sequential signal generator 901 and the output signals of the random signal generator 902 are selected in the multiplexers by a selection signal SS_SEL, and are outputted as the charging control signals CP1 and CP2 or the loading control signals LP1 to LP3. That is, the output signals of the sequential signal generator 901 and the output signals of the random signal generator 902 are selected in the multiplexers 903 and 904 by the selection signal SS_SEL, and are outputted as the charging control signals CP1 and CP2 and the loading control signals LP1 to LP3 of FIG. 3 or the charging control signals CP1 and CP2 and the loading control signals LP1 and LP2 of FIG. 4.

Figure 10:
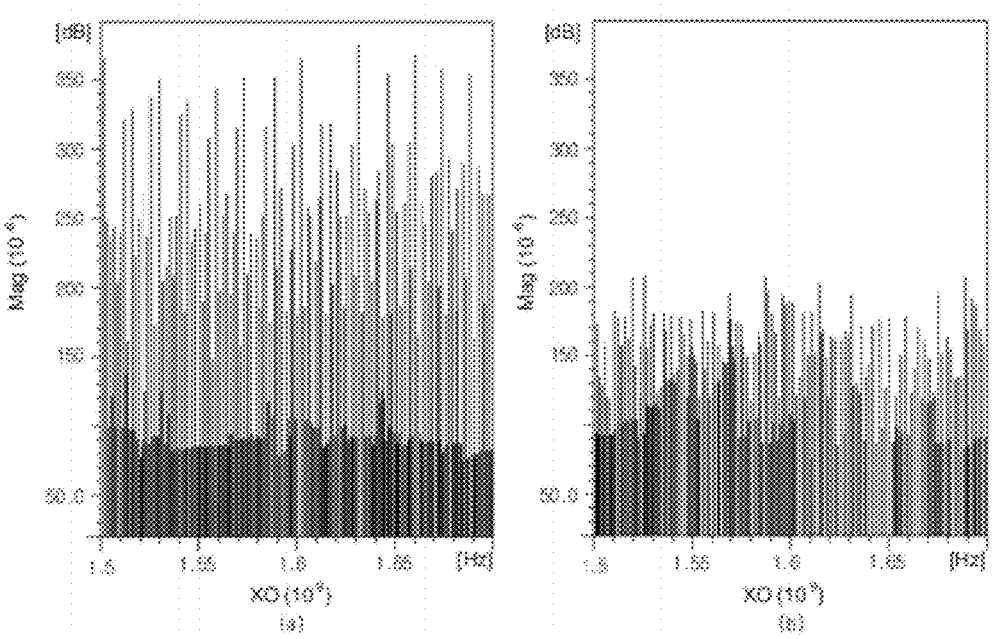
FIGS. 10A and 10B are diagrams illustrating results obtained by simulating an electromagnetic interference signal before and after the present invention is applied.

FIG. 10A is a diagram illustrating electromagnetic interference (EMI) occurring in a power supply circuit to which the present invention is not applied, and FIG. 10B is a diagram illustrating the experimental result which shows a reduction in electromagnetic interference in the power supply circuit in accordance with the present invention. It can be understood that electromagnetic interference is significantly suppressed by the present invention.

In accordance with the present invention, when a power supply circuit provided in a gate power driver generates a gate high voltage or a gate low voltage, the durations of charging control signals and loading control signals are periodically or randomly changed, so that electromagnetic interference is suppressed.

Furthermore, charging control signals and loading control signals having the same phase are used whenever a new frame starts, so that an image can be stably displayed.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A power supply circuit of a liquid crystal display device, comprising:

a first positive polarity charge charging unit comprising a first capacitor having both ends connected to a positive power terminal and a negative power terminal through first and second switches, thereby configured to charge a charge;

a second positive polarity charge charging unit comprising a second capacitor having both ends connected to the positive power terminal and a ground terminal through third and fourth switches, thereby configured to charge a charge;

a first positive polarity charge loading unit configured to load the charge, which is supplied through the positive power terminal, to a negative polarity terminal of the first capacitor of the first positive polarity charge charging unit;

a second positive polarity charge loading unit configured to load the charge, which is charged in the first capacitor of the first positive polarity charge charging unit, to a negative polarity terminal of the second capacitor of the second positive polarity charge charging unit;

a third positive polarity charge loading unit configured to load the charge, which is charged in the second capacitor of the second positive polarity charge charging unit, to a third capacitor connected to a gate high power terminal; and a positive polarity charge charging and loading control unit configured to:

output charging control signals to the first and second switches of the first positive polarity charge charging unit and the third and fourth switches of the second positive polarity charge charging unit, wherein the charging control signals have the same phase whenever a new frame starts;

output loading control signals to each switch of the first to third positive polarity charge loading units, wherein the loading control signals have the same phase whenever a new frame starts; and periodically or irregularly change durations of the charging control signals and durations of the loading control signals such that each of the charging control signals and the loading control signals has a frequency that changes in a regular pattern with respect to a center frequency or hops irregularly about the center frequency.

2. The power supply circuit of a liquid crystal display device according to claim 1, wherein the first positive polarity charge loading unit comprises a fifth switch which is connected between the positive power terminal and the negative polarity terminal of the first capacitor of the first positive polarity charge charging unit.

3. The power supply circuit of a liquid crystal display device according to claim 1, wherein the second positive polarity charge loading unit comprises a sixth switch which is connected between a positive polarity terminal of the first switch of the first positive polarity charge charging unit and a negative polarity terminal of the second switch of the second positive polarity charge charging unit.

4. The power supply circuit of a liquid crystal display device according to claim 1, wherein the third positive polarity charge loading unit comprises a seventh switch and a third capacitor, which are serially connected between a positive polarity terminal of the second capacitor of the second positive polarity charge charging unit and the ground terminal.

5. The power supply circuit of a liquid crystal display device according to claim 1, wherein the charging control signals have a phase opposite to a phase of the loading control signals.

6. The power supply circuit of a liquid crystal display device according to claim 1, wherein the positive polarity charge charging and loading control unit comprises:

a horizontal synchronization signal generator configured to refer to an actually inputted first horizontal synchronization signal to generate a second horizontal synchronization signal similar to the first horizontal synchronization signal;

a multiplexer configured to select and output one of the two horizontal synchronization signals according to a selection signal;

a reset signal generator configured to delay the selected horizontal synchronization signal, which is inputted from the multiplexer, through a delay section by a predetermined time, and to generate a reset signal by performing a NAND operation on the delayed signal through a NAND gate;

a counter configured to be reset by the reset signal and to generate an n-bit output with a same period as a period of the selected horizontal synchronization signal; and a PWM generator configured to receive the output of the counter to generate the charging control signals and the loading control signals.

7. The power supply circuit of a liquid crystal display device according to claim 6, wherein the PWM generator comprises:

a sequential signal generator configured to generate the charging control signals and the loading control signals by sequentially changing the charging control signals and the loading control signals, to generate the control signals with a same value whenever each frame starts, and to not operate in a duration in which a vertical synchronization signal is at a low level;

a random signal generator configured to generate the charging control signals and the loading control signals by irregularly changing the charging control signals and the loading control signals, to generate the control signals with a same value whenever each frame starts, and to not operate in a duration in which a vertical synchronization signal is at a low level; and multiplexers configured to select output signals of the sequential signal generator or output signals of the random signal generator according to a selection signal, and to output the selected signals.

8. The power supply circuit of a liquid crystal display device according to claim 7, wherein the sequential signal generator is configured to sequentially change phases of the charging control signals and the loading control signals.

9. The power supply circuit of a liquid crystal display device according to claim 7, wherein the random signal generator is configured to irregularly change phases of the charging control signals and the loading control signals.

10. A power supply circuit of a liquid crystal display device, comprising:

a negative polarity charge charging unit comprising a first capacitor having both ends connected to a positive power terminal and a negative power terminal through first and second switches, thereby configured to charge a charge;

a first negative polarity charge loading unit configured to load a charge, which is supplied through a ground terminal, to a positive polarity terminal of the first capacitor of the negative polarity charge charging unit;

a second negative polarity charge loading unit configured to load the negative polarity charge, which is charged in the first capacitor of the negative polarity charge charging unit, to a second capacitor connected to a gate low power terminal; and a negative polarity charge charging and loading control unit configured to:

output charging control signals to the first and second switches of the negative polarity charge charging unit, wherein the charging control signals have the same phase whenever a new frame starts;

output loading control signals to each switch of the first and second negative polarity charge loading units, wherein the loading control signals have the same phase whenever a new frame starts; and periodically or irregularly change durations of the charging control signals and durations of the loading control signals such that each of the charging control signals and the loading control signals has a frequency that changes in a regular pattern with respect to a center frequency or hops irregularly about the center frequency.

11. The power supply circuit of a liquid crystal display device according to claim 10, wherein the first negative polarity charge loading unit comprises a third switch which is connected between the ground terminal and a positive polarity terminal of the first capacitor of the negative polarity charge charging unit.

12. The power supply circuit of a liquid crystal display device according to claim 10, wherein the second negative polarity charge loading unit comprises a fourth switch and a second capacitor, which are serially connected between a negative polarity terminal of the first capacitor of the negative polarity charge charging unit and the ground terminal.

13. The power supply circuit of a liquid crystal display device according to claim 10, wherein the charging control signals have a phase opposite to a phase of the loading control signals.

14. The power supply circuit of a liquid crystal display device according to claim 10, wherein the negative polarity charge charging and loading control unit comprises:

a horizontal synchronization signal generator configured to refer to an actually inputted first horizontal synchronization signal to generate a second horizontal synchronization signal similar to the first horizontal synchronization signal;

a multiplexer configured to select and output one of the two horizontal synchronization signals according to a selection signal;

a reset signal generator configured to delay the selected horizontal synchronization signal, which is inputted from the multiplexer, through a delay section by a predetermined time, and to generate a reset signal by performing a NAND operation on the delayed signal through a NAND gate;

a counter configured to be reset by the reset signal and to generate an n-bit output with a same period as a period of the selected horizontal synchronization signal; and a PWM generator configured to receive the output of the counter to generate the charging control signals and the loading control signals.

15. The power supply circuit of a liquid crystal display device according to claim 14, wherein the PWM generator comprises:

a sequential signal generator configured to generate the charging control signals and the loading control signals by sequentially changing the charging control signals and the loading control signals, to generate the control signals with a same value whenever each frame starts, and to not operate in a duration in which a vertical synchronization signal is at a low level;

a random signal generator configured to generate the charging control signals and the loading control signals by irregularly changing the charging control signals and the loading control signals, to generate the control signals with a same value whenever each frame starts, and to not operate in a duration in which a vertical synchronization signal is at a low level; and multiplexers configured to select output signals of the sequential signal generator or output signals of the random signal generator according to a selection signal, and to output the selected signals.

16. The power supply circuit of a liquid crystal display device according to claim 15, wherein the sequential signal generator is configured to sequentially change phases of the charging control signals and the loading control signals.

17. The power supply circuit of a liquid crystal display device according to claim 15, wherein the random signal generator is configured to irregularly change phases of the charging control signals and the loading control signals.

18. A power supply circuit of a liquid crystal display device, which comprises one or more positive polarity charge charging units driven by a charging control signal and one or more positive polarity charge loading units driven by a loading control signal, and is configured to supply a gate high voltage to a liquid crystal panel, wherein the power supply circuit comprises a charging/loading control unit configured to:

output the charging control signal to the one or more positive polarity charge charging units, wherein the charging control signal has the same phase whenever a new frame starts;

output the loading control signal to the one or more positive polarity charge loading units, wherein the loading control signal has the same phase whenever a new frame starts; and periodically or irregularly change durations of the charging control signal and the loading control signal such that each of the charging control signal and the loading control signal has a frequency that changes in a regular pattern with respect to a center frequency or hops irregularly about the center frequency, and such that the gate high voltage is generated according to the charging control signal and the loading control signal.

19. A power supply circuit of a liquid crystal display device, which comprises one or more negative polarity charge charging units driven by a charging control signal and one or more negative polarity charge loading units driven by a loading control signal, and is configured to supply a gate low voltage to a liquid crystal panel, wherein the power supply circuit comprises a charging/loading control unit configured to:

output the charging control signal to the one or more negative polarity charge charging units, wherein the charging control signal has the same phase whenever a new frame starts;

output the loading control signal to the one or more negative polarity charge loading units, wherein the loading control signal has the same phase whenever a new frame starts; and periodically or irregularly change durations of the charging control signal and the loading control signal such that each of the charging control signal and the loading control signal has a frequency that changes in a regular pattern with respect to a center frequency or hops irregularly about the center frequency, and such that the gate low voltage is generated according to the charging control signal and the loading control signal.

* * * * *